US009818356B2

(12) United States Patent
Won et al.

(10) Patent No.: US 9,818,356 B2
(45) Date of Patent: Nov. 14, 2017

(54) DISPLAY DEVICE

(71) Applicant: Samsung Display Co., Ltd., Yongin, Gyeonggi-do (KR)

(72) Inventors: Myung-Ho Won, Seoul (KR); Jin-Mo Kwon, Yongin-si (KR); Yonghwan Kim, Asan-si (KR); Chul Shin, Busan (KR); Kwan-Woo Lee, Asan-si (KR); Sung-Woon Im, Asan-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 655 days.

(21) Appl. No.: 13/937,368

(22) Filed: Jul. 9, 2013

(65) Prior Publication Data

US 2014/0210700 A1 Jul. 31, 2014

(30) Foreign Application Priority Data

Jan. 30, 2013 (KR) ..... 10-2013-0010593

(51) Int. Cl.
*G09G 3/36* (2006.01)

(52) U.S. Cl.
CPC ... *G09G 3/3677* (2013.01); *G09G 2310/0289* (2013.01)

(58) Field of Classification Search
CPC ..... G09G 3/3677; G09G 2310/0286; G09G 3/3648; G09G 3/3696; G09G 2300/0426; G09G 2310/08; G09G 3/3614; G09G 3/3688; G09G 2310/0289; G09G 2320/0233; G09G 3/3611; G09G 3/3655; G09G 2310/06; G09G 2310/0267; G02B 27/017
See application file for complete search history.

(56) References Cited

U.S. PATENT DOCUMENTS 6,362,798 B1 * 3/2002 Kimura ..... H01L 21/76895 257/E21.59
7,817,123 B2 * 10/2010 Do ..... G09G 3/3655 345/204
2003/0063074 A1 * 4/2003 Kumagawa ..... G02F 1/136213 345/204
2004/0207620 A1 10/2004 Ra
(Continued)

FOREIGN PATENT DOCUMENTS

JP 2007-188089 7/2007
KR 1020050049107 5/2005
(Continued)

*Primary Examiner* — Jose Soto Lopez
(74) *Attorney, Agent, or Firm* — F. Chau & Associates, LLC

(57) ABSTRACT

A display device includes a display panel including gate lines, data lines, and pixels connected to the gate line and the data lines, a gate driver driving the gate lines, a level shifter applying a gate clock signal to the gate driver, a data driver driving the data lines, a timing controller generating control signals to control the level shifter, the gate driver, and the data driver, and a backlight unit providing light to the display panel. The level shifter sets a voltage level of a gate-on voltage of the gate clock signal to a voltage level of a first gate-on voltage or a voltage level of a second gate-on voltage higher than the first gate-on voltage in response to a gate-on control signal.

16 Claims, 14 Drawing Sheets

(56) References Cited

U.S. PATENT DOCUMENTS

2006/0274252 A1* 12/2006 Son ..... G02F 1/13452 349/149
2007/0070026 A1* 3/2007 Cho ..... G09G 3/3413 345/102
2007/0085798 A1* 4/2007 Hashimoto ..... G09G 3/3648 345/93
2007/0296682 A1* 12/2007 Hwang ..... G09G 3/3677 345/100
2008/0088550 A1 4/2008 Kim et al.
2008/0136809 A1* 6/2008 Lee ..... G09G 3/3677 345/214
2008/0150859 A1* 6/2008 Song ..... G09G 3/3648 345/87
2008/0170064 A1* 7/2008 Lee ..... G09G 3/3677 345/214
2008/0211760 A1* 9/2008 Baek ..... G09G 3/3677 345/98
2008/0316157 A1* 12/2008 Park ..... G09G 3/3611 345/89
2009/0059131 A1* 3/2009 Wang ..... G02F 1/133604 349/69
2009/0225104 A1* 9/2009 Hu ..... G09G 3/3677 345/690
2009/0262057 A1* 10/2009 Yoon ..... G09G 3/3406 345/89
2009/0273555 A1* 11/2009 Song ..... G09G 3/3666 345/96
2009/0303403 A1* 12/2009 Park ..... G09G 3/3696 349/33
2010/0033415 A1* 2/2010 Bae ..... G09G 3/3696 345/94
2010/0033475 A1* 2/2010 Choi ..... G09G 3/3648 345/214
2010/0045644 A1* 2/2010 Lee ..... G09G 3/3233 345/208
2010/0085348 A1* 4/2010 Bae ..... G09G 3/3648 345/213
2010/0123742 A1* 5/2010 Jang ..... G09G 3/342 345/690
2010/0177082 A1* 7/2010 Joo ..... G09G 3/3677 345/211
2010/0220079 A1* 9/2010 Bang ..... G09G 3/3648 345/204
2011/0102309 A1* 5/2011 Cho ..... G09G 3/3648 345/92
2011/0128259 A1 6/2011 Suzuki et al.
2011/0134099 A1* 6/2011 Tsubata ..... G02F 1/13624 345/211
2011/0175878 A1* 7/2011 Hsiao ..... G09G 3/3677 345/211
2012/0019497 A1* 1/2012 Kim ..... G09G 3/3677 345/210
2012/0162186 A1* 6/2012 Kim ..... G02F 1/167 345/212
2012/0242639 A1* 9/2012 Lee ..... G09G 3/003 345/211
2013/0063403 A1* 3/2013 Sugita ..... G09G 3/3406 345/175
2013/0083083 A1* 4/2013 Woo ..... G09G 3/3208 345/690
2013/0249817 A1* 9/2013 Jung ..... G06F 3/0412 345/173
2014/0104248 A1* 4/2014 Won ..... G09G 5/00 345/204
2014/0118421 A1* 5/2014 Saitoh ..... G09G 3/3688 345/690
2014/0210875 A1* 7/2014 Sumi ..... H04N 13/0409 345/694

FOREIGN PATENT DOCUMENTS

KR 1020060011591 2/2006
KR 1020070050618 5/2007
KR 1020070063638 6/2007
KR 1020070103189 10/2007
KR 1020080017990 2/2008
KR 1020080060681 7/2008

* cited by examiner

DISPLAY DEVICE

CROSS-REFERENCE TO RELATED APPLICATION

This application claims priority under 35 U.S.C. §119 to Korean Patent Application No. 10-2013-0010593, filed on Jan. 30, 2013, the disclosure of which is incorporated by reference herein in its entirety.

TECHNICAL FIELD

The present disclosure relates to a display device that displays an image.

DISCUSSION OF THE RELATED ART

A liquid crystal display may include a separate light source (e.g., a backlight unit including a backlight lamp) that supplies light to a liquid crystal display panel of the liquid crystal display. A light emitting diode (LED) may be used as the light source as a result of having low power consumption, being eco-friendly, and allowing for a slim design. The backlight unit includes a plurality of LEDs that supply the light for the display device. The LEDs may be arranged adjacent to one or more long sides of the display panel. The light emitted from the LEDs is diffused by a light guide plate, and converted to uniformly distributed light while passing through diffusion and prism sheets disposed on the light guide plate. However, a hot spot (e.g., an area in which the brightness is too high relative to other areas) may still occur in areas near the LEDs, even when the light guide plate and the diffusion and prism sheets are used.

In addition, the backlight unit may be periodically or non-periodically turned on and off. When a display period of the image displayed on the display panel is not matched with an on-and-off period of the backlight unit, the brightness of the displayed image may be varied according to the turning on and off of the backlight unit.

SUMMARY

Exemplary embodiments of the present disclosure provide a display device capable of reducing or eliminating the appearance of a hot spot.

Exemplary embodiments of the present disclosure provide a display device capable of reducing a brightness variation caused by turning on and turning off a backlight unit.

Exemplary embodiments of the inventive concept provide a display device including a display panel that includes a plurality of gate lines, a plurality of data lines, and a plurality of pixels each being connected to a corresponding gate line of the gate lines and a corresponding data line of the data lines, a gate driver that drives the gate lines, a level shifter that applies a gate clock signal to the gate driver, a data driver that drives the data lines, a timing controller that generates a gate-on control signal and a plurality of control signals to control the level shifter, the gate driver, and the data driver, and a backlight unit that provides a light to the display panel. The level shifter sets a voltage level of a gate-on voltage of the gate clock signal to a level of a first gate-on voltage or a level of a second gate-on voltage higher than the first gate-on voltage in response to the gate-on control signal.

In exemplary embodiments, the gate-on control signal is activated when a portion of the gate lines, which is disposed adjacent to the backlight unit, is activated, and the level shifter outputs the first gate-on voltage as the gate-on voltage when the gate-on control signal is activated and outputs the second gate-on voltage as the gate-on voltage when the gate-on control signal is not activated.

In exemplary embodiments, the gate-on control signal is output from the timing controller.

The level shifter may include a voltage generator that outputs the first gate-on voltage and the second gate-on voltage, a gate-on voltage selector that outputs one of the first gate-on voltage and the second gate-on voltage as the gate-on voltage in response to the gate-on control signal, and a gate clock generator that receives the gate-on voltage and a gate-off voltage and outputs the gate-clock signal in response to a gate pulse signal received from the timing controller.

In exemplary embodiments, the gate clock generator includes a signal generator that generates a first switching signal and a second switching signal in response to the gate pulse signal, a first switch that outputs one of the gate-on voltage and the gate-off voltage in response to the first switching signal, and a second switch that outputs one of the gate-on voltage and the gate-off voltage in response to the second switching signal.

In exemplary embodiments, the data driver includes a shift register that receives a vertical synchronization start signal from the timing controller and outputs a plurality of shift signals in synchronization with a line latch signal, a register that stores a gate-on information signal, and a logic circuit that outputs the gate-on control signal in response to the shift signal and the gate-on information signal.

In exemplary embodiments, the gate-on information signal is set to allow the gate-on control signal to be activated when the portion of the gate lines, which is disposed adjacent to the backlight unit, is activated.

In exemplary embodiments, the level shifter sets the voltage level of the gate-on voltage of the gate clock signal to one of the level of the first gate-on voltage and the level of the second gate-on voltage higher than the first gate-on voltage in response to the vertical synchronization start signal and the gate-on control signal received from the timing controller.

In exemplary embodiments, the level shifter includes a voltage generator that outputs the first gate-on voltage and the second gate-on voltage, a gate-on voltage selector that outputs one of the first gate-on voltage and the second gate-on voltage as the gate-on voltage in response to the vertical synchronization start signal and the gate-on control signal, and a gate clock generator that receives the gate-on voltage and a gate-off voltage and outputs the gate clock signal in response to a gate pulse signal received from the timing controller.

In exemplary embodiments, the gate-on voltage generator includes a first level shifter that boosts the gate-on control signal and outputs the boosted gate-on control signal, a first output circuit that outputs the second gate-on voltage as the gate-on voltage in response to the boosted gate-on control signal, a second level shifter that boosts the vertical synchronization start signal and outputs the boosted vertical synchronization start signal, and a second output circuit that outputs the first gate-on voltage as the gate-on voltage in response to the boosted vertical synchronization start signal.

In exemplary embodiments, the first output circuit includes a first diode connected between the boosted gate-on control signal and a first node, a first capacitor connected between the first node and a ground voltage, a first transistor connected between the first node and the ground voltage and including a control electrode connected to the boosted vertical synchronization start signal, and a second transistor connected between the second gate-on voltage and an output node and including a control electrode connected to the first node.

In exemplary embodiments, the second output circuit includes a second diode connected between the boosted synchronization start signal and a second node, a second capacitor connected between the second node and a ground voltage, a third transistor connected between the second node and the ground voltage and including a control electrode connected to the boosted gate-on control signal, and a fourth transistor connected between the first gate-on voltage and an output node and including a control electrode connected to the second node.

In exemplary embodiments, the backlight unit is periodically turned on and turned off, the gate-on control signal is activated when the backlight unit is turned on, and the level shifter sets the gate-on voltage of the gate clock signal to the second gate-on voltage when the gate-on control signal is activated and sets the gate-on voltage of the gate clock signal to the first gate-on voltage when the gate-on control signal is not activated.

In exemplary embodiments, the level shifter includes a voltage generator that outputs the first gate-on voltage and the second gate-on voltage, a gate-on voltage selector that outputs one of the first gate-on voltage and the second gate-on voltage as the gate-on voltage in response to the backlight control signal, and a gate clock generator that receives the gate-on voltage and a gate-off voltage and outputs the gate clock signal in response to a gate pulse signal from the timing controller.

In exemplary embodiments, the gate-on voltage generator includes a first level shifter that boosts a backlight control signal from the timing controller and outputs the boosted backlight control signal, a first output circuit that outputs the second gate-on voltage as the gate-on voltage in response to the boosted backlight control signal, an inverter that receives the backlight control signal and outputs an inverted backlight control signal, a second level shifter that boosts the inverted backlight control signal and outputs the boosted inverted backlight control signal, and a second output circuit that outputs the first gate-on voltage as the gate-on voltage in response to the boosted inverted backlight control signal.

In exemplary embodiments, the first output circuit includes a first capacitor connected between the boosted backlight control signal and a ground voltage, and a first transistor connected between the second gate-on voltage and an output node and including a control electrode connected to the boosted backlight control signal.

In exemplary embodiments, the second output circuit includes a second capacitor connected between the boosted inverted backlight control signal and the ground voltage, and a second transistor connected between the first gate-on voltage and the output node and including a control electrode connected to the boosted inverted backlight control signal.

In an exemplary embodiment, a display device includes a gate driver configured to drive a plurality of gate lines, a timing controller configured to generate a gate-on control signal, and a level shifter configured to receive the gate-on control signal, and generate a gate clock signal having a gate-on voltage in response to receiving the gate-on control signal. A voltage level of the gate-on voltage is set to a voltage level of a first gate-on voltage or a voltage level of a second gate-on voltage by the level shifter. The voltage level of the second gate-on voltage is higher than the voltage level of the first gate-on voltage.

According to exemplary embodiments, the gate-on voltage used to drive the gate lines disposed at a side portion of the display panel, which is adjacent to the light sources, is lowered, and thus, the appearance of a hot spot may be prevented or reduced.

In addition, in exemplary embodiments, the voltage level of the gate-on voltage used to drive the gate lines is increased during the turned-on period of the backlight unit, resulting in an improvement of the charge rate of the pixels in the display panel. As a result, a waterfall noise effect that may occur when a display period of the image displayed on the display panel is different from a turn-on and turn-off period of the backlight unit may be prevented or reduced.

BRIEF DESCRIPTION OF THE DRAWINGS

The above and other features of the present disclosure will become more apparent by describing in detail exemplary embodiments thereof with reference to the accompanying drawings, in which.

DETAILED DESCRIPTION OF THE EXEMPLARY EMBODIMENTS

Figure 1:
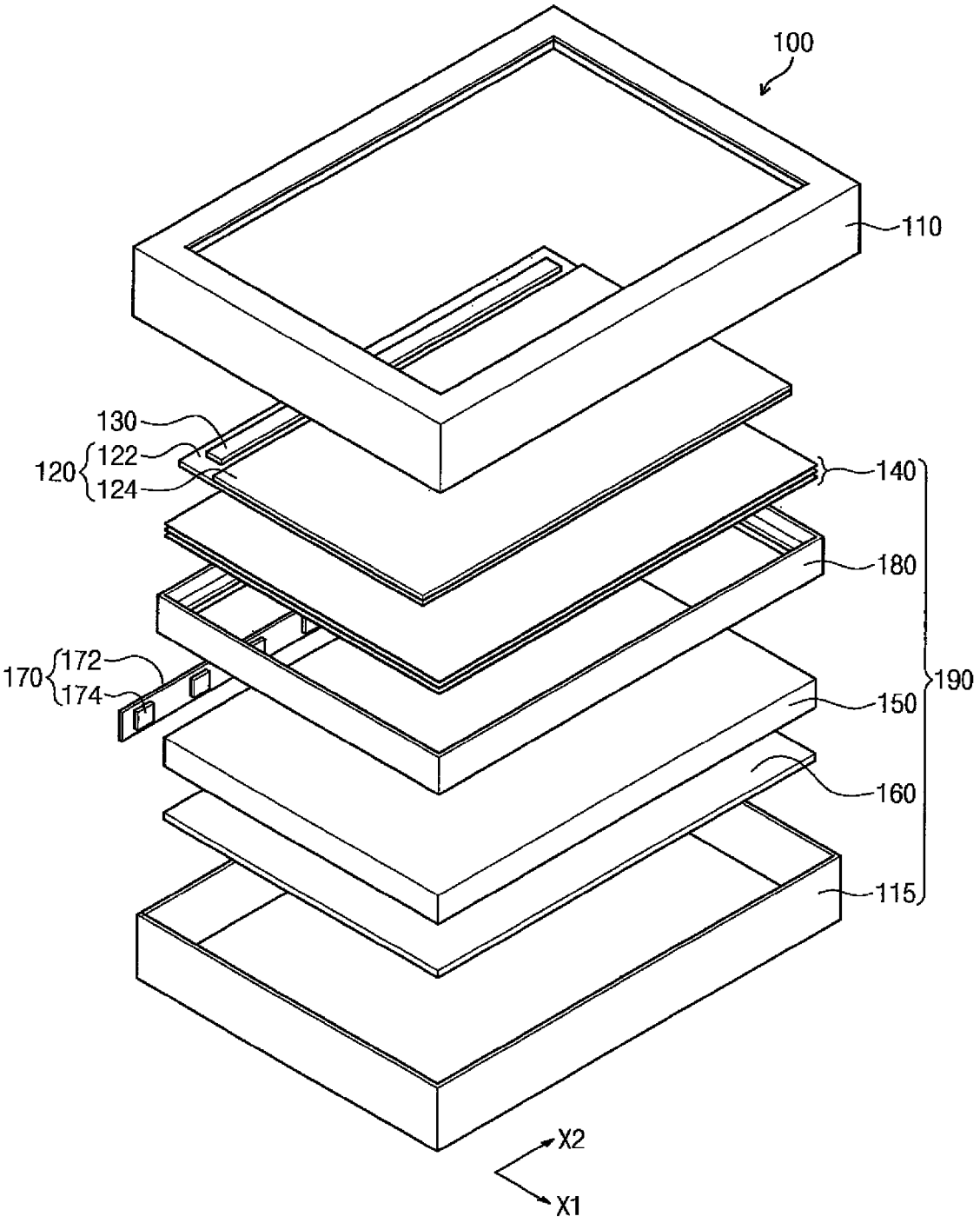
FIG. 1 is an exploded perspective view showing a display device, according to an exemplary embodiment of the present disclosure.

Exemplary embodiments will be described more fully hereinafter with reference to the accompanying drawings. Like reference numerals may refer to like elements throughout the accompanying drawings. The terms "first" and "second" are used herein to describe various components and parts, and the components and parts are not limited to the terms "first" and "second." The terms "first" and "second" are used only to distinguish between each of the components and parts. Thus, a first component or part may indicated a second component or pat.

FIG. 1 is an exploded perspective view showing a display device, according to an exemplary embodiment of the present disclosure.

Referring to FIG. 1, in an exemplary embodiment, a display device 100 includes an upper receiving container 110, a display panel 120, and a backlight assembly 190. The backlight assembly 190 includes an optical sheet 140, a mold frame 180, a light guide plate 150, a backlight unit 170, a reflective sheet 160, and a lower receiving container 115.

The display panel 120 includes a lower display substrate 122 and an upper display substrate 124. The lower display substrate 122 includes gate lines, data lines, thin-film transistors, and pixel electrodes, and the upper display substrate 124 includes a black matrix and a common electrode, and faces the lower display substrate 122. According to an exemplary embodiment, the black matrix and the common electrode may be disposed on the lower display substrate 122 rather than the upper display substrate 124. The display panel 120 displays image information using light provided from the backlight unit 170. According to an exemplary embodiment, one or more polarizing films may be respectively disposed on upper and lower surfaces of the display panel 120. The upper display substrate 124 may have a size smaller than the lower display substrate 122. As a result, a driving circuit 130, which may include one or more chips, may be mounted on an edge of the lower display substrate 122, which is not overlapped with the upper display substrate 124, as shown in FIG. 1.

When a thin-film transistor is turned on, an electric field is generated between a pixel electrode and a common electrode. Due to the electric field, an arrangement of liquid crystal molecules of a liquid crystal layer disposed between the upper display substrate 124 and the lower display substrate 122 is changed, and a transmittance of the light passing through each pixel may be varied. As described above, the display panel 120 controls the transmittance of the light provided from the backlight unit 170 and passing through the liquid crystal layer, thereby displaying a desired image.

The upper receiving container 110 provides a space shaped and dimensioned to accommodate the display panel 120. The upper receiving container 110 is provided with a window formed therethrough to expose the display panel 120. The upper receiving container 110 is coupled to the lower receiving container 115.

The mold frame 180 is disposed between the upper receiving container 110 and the lower receiving container 115, and accommodates the display panel 120 and the optical sheet 140. The optical sheet 140 is disposed on the light guide plate 150, and diffuses and condenses the light exiting from the light guide plate 150. In an exemplary embodiment, the optical sheet 140 includes a first prism sheet, a second prism sheet, and a protective sheet. The first and second prism sheets refract the light exiting from the light guide plate 150 to allow the light to travel to the display panel 120, which may improve the brightness of the display device 100 within an effective viewing angle of the display device 100. The protective sheet disposed on the first and second prism sheets protects the surface of the prism sheets and diffuses the light, resulting in uniformity of light distribution. The configuration of the optical sheet 140 is not limited to the configuration described above. For example, according to exemplary embodiments, the optical sheet 140 may include one prism sheet and one or more protective sheets, or three or more prism sheets and one or more protective sheets, as well as additional components.

The light guide plate 150 is accommodated in the lower receiving container 115 and disposed adjacent to a plurality of light sources 174 of the backlight unit 170. The light guide plate 150 guides the light emitted from the light sources 174. The light guide plate 150 diffuses the light emitted from the light sources 174 and may prevent the formation of a bright line, which may be caused by the arrangement of the light sources 174, from occurring on the display device 100. The light guide plate 150 includes a light incident portion into which the light emitted from the light sources 174 is incident, and an opposite portion facing the light incident portion.

The reflective sheet 160 is disposed under the light guide plate 150, and reflects the light that may leak downward from the light guide plate 150. The reflective sheet 160 may reduce light loss and may improve uniformity of the light. The reflective sheet 160 may have a sheet shape or a pattern shape formed by coating a material having high reflectance on the lower receiving container 115.

The backlight unit 170 is disposed in the lower receiving container 115 and includes a circuit board 172 and the light sources 174 mounted on one surface of the circuit board 172. Each of the light sources 174 may be a point light source such as, for example, a light emitting diode. The light sources 174 are arranged on the surface of the circuit board 172 along a second direction X2 and are spaced apart from each other. Although FIG. 1 shows the light sources 174 arranged in a single line, the configuration of the light sources 174 is not limited thereto. For example, in an exemplary embodiment, the light sources 174 may be arranged in a plurality of lines extending along the second direction X2, or in various other configurations extending along the second direction X2. Each of the light source 174 may be, for example, a line light source. The circuit board 172 on which the light sources 174 are mounted is disposed in the lower receiving container 115. Although four light sources 174 are visible in FIG. 1, the number of light sources 174 is not limited thereto. Further, although the backlight unit 170 is disposed adjacent to one long side of the display panel 120 in FIG. 1, exemplary embodiments of the present disclosure are not limited thereto. For example, the backlight unit 170 may be disposed adjacent to both long sides of the display panel 120 while interposing the display panel 120 therebetween. In addition, according to an exemplary embodiment, the backlight unit 170 may be disposed adjacent to one or both short sides of the display panel 120 and may extend in the first direction X1.

Figure 2:
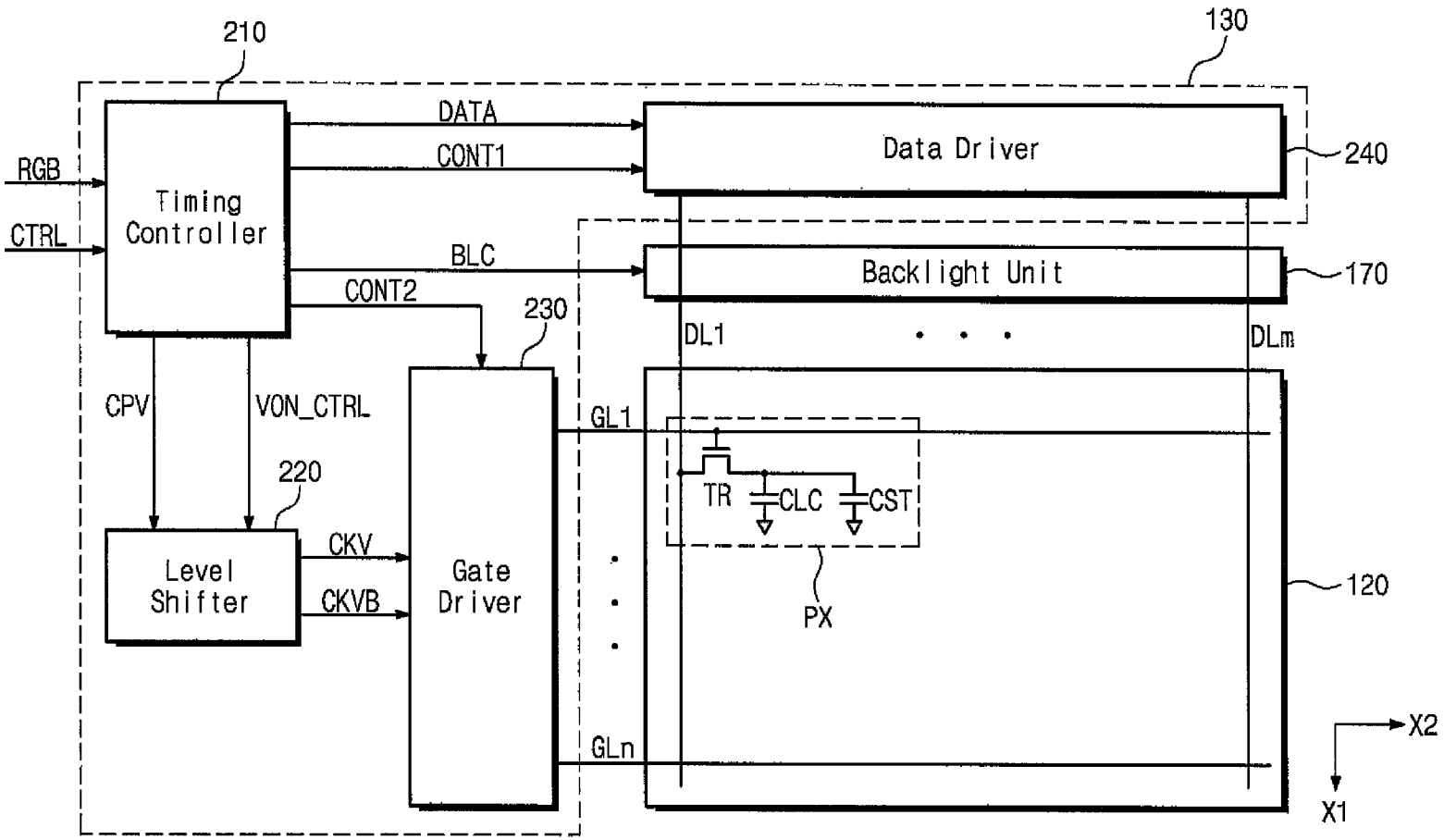
FIG. 2 is a block diagram showing a display panel, a driving circuit, and a backlight unit of the display device shown in FIG. 1, according to an exemplary embodiment of the present disclosure.

FIG. 2 is a block diagram showing the display panel, the driving circuit, and the backlight unit of the display device shown in FIG. 1, according to an exemplary embodiment of the present disclosure.

Referring to FIG. 2, the display panel 120 displays the image. Although the display panel 120 is described in exemplary embodiments as being a liquid crystal display panel including the backlight unit 170, the display panel 120 is not limited thereto.

The display panel 120 includes a plurality of data lines DL1 to DLm extending in the first direction X1, a plurality of gate lines GL1 to GLn extending in the second direction X2 and crossing the data lines DL1 to DLm, and a plurality of pixels PX arranged in areas defined by the data lines DL1 to DLm and the gate lines GL1 to GLn. The data lines DL1 to DLm are insulated from the gate lines GL1 to GLn. Each pixel PX includes a thin-film transistor TR, a liquid crystal capacitor CLC, and a storage capacitor CST.

Referring to FIG. 2, since the pixels PX have the same structure and function, only one pixel will be described in detail. The thin-film transistor TR includes a gate electrode connected to a first gate line GL1 of the gate lines GL1 to GLn, a source electrode connected to a first data line DL1 of the data lines DL1 to DLm, and a drain electrode connected to the liquid crystal capacitor CLC and the storage capacitor CST. First terminals of the liquid crystal capacitor CLC and the storage capacitor CST are connected to the drain electrode of the thin-film transistor TR in parallel. Second terminals of the liquid crystal capacitor CLC and the storage capacitor CST are connected to a common voltage.

The driving circuit 130 includes a timing controller 210, a level shifter 220, a gate driver 230, and a data driver 240.

The timing controller 210 receives image signals RGB and control signals CTRL. The control signals CTRL may include, for example, a vertical synchronization signal, a horizontal synchronization signal, a main clock signal, a data enable signal, etc., and are used to control the image signals RGB. The timing controller 210 converts the image signals RGB to image data signal DATA, which is in a format that can be used by the display panel 120, based on the control signals CTRL. The timing controller 210 applies the image data signal DATA and a first control signal CONT1 to the data driver 240, and applies a second control signal CONT2 to the gate driver 230. In the exemplary embodiment shown in FIG. 2, the first control signal CONT1 includes a horizontal synchronization start signal, a clock signal, a polarity inversion signal, and a line latch signal, and the second control signal CONT2 includes a vertical synchronization start signal, an output enable signal, and a gate pulse signal CPV. The timing controller 210 may convert the image data signal DATA in various manners in accordance with the arrangement of the pixels PX and a display frequency of the display panel 120. The timing controller 210 applies the gate pulse signal CPV and a gate-on control signal VON_CTRL to the level shifter 220. In addition, the timing controller 210 applies a backlight control signal BLC to the backlight unit 170.

The level shifter 220 generates a first gate clock signal CKV and a second gate clock signal CKVB in response to the gate pulse signal CPV and the gate-on control signal VON_CTRL. Each of the first and second gate clock signals CKV and CKVB has a gate-on voltage level and a gate-off voltage level. The gate-on voltage level may be set by the gate pulse signal CPV and the gate-on control signal VON_CTRL.

The gate driver 230 drives the gate lines GL1 to GLn in response to the second control signal CONT2 received from the timing controller 210, and the first and second gate clock signals CKV and CKVB received from the level shifter 220. The gate driver 230 includes a gate driver integrated circuit. According to an exemplary embodiment, the gate driver 230 is configured in a circuit using an amorphous silicon gate thin-film transistor (a-Si TFT), an oxide semiconductor, a crystalline semiconductor, or a polycrystalline semiconductor. In this case, the gate driver 230 is directly integrated on the lower display substrate 122 without being mounted on the lower display substrate 122. In an exemplary embodiment, the gate driver 230 may be separate from, and mounted on the lower display substrate 122.

The data driver 240 drives the data lines DL1 to DLm in response to the image data signal DATA and the first control signal CONT1 received from the timing controller 210.

Figure 3:
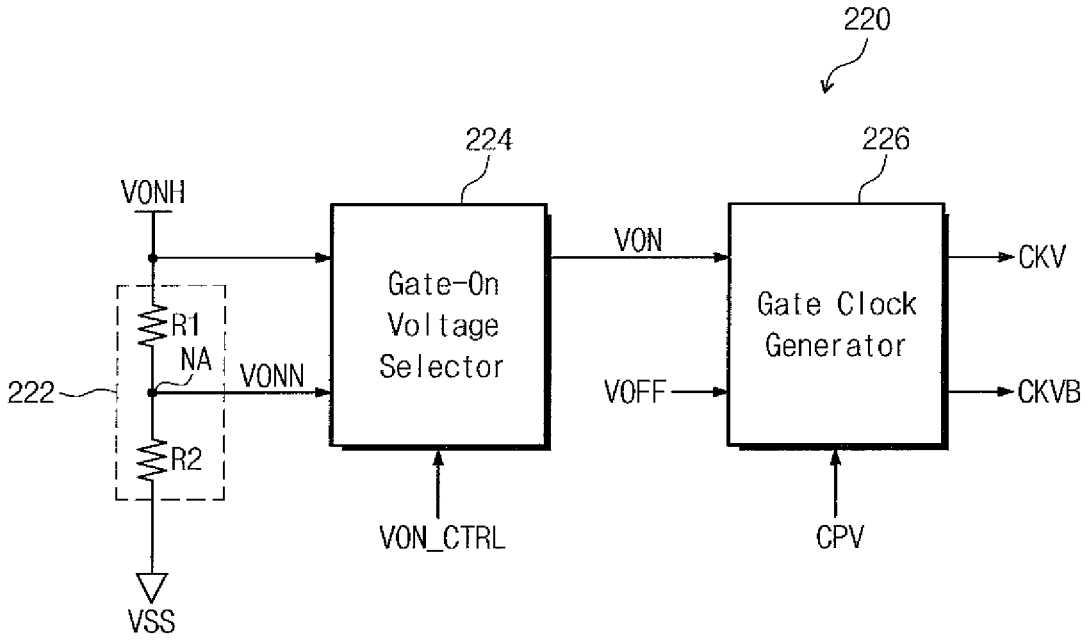
FIG. 3 is a block diagram showing a level shifter shown in FIG. 2, according to an exemplary embodiment of the present disclosure.

FIG. 3 is a block diagram showing the level shifter shown in FIG. 2, according to an exemplary embodiment of the present disclosure.

Referring to FIG. 3, the level shifter 220 includes a voltage divider 222, a gate-on voltage selector 224, and a gate clock generator 226. The voltage divider 222 includes resistors R1 and R2. The resistor R1 is connected between a second gate-on voltage VONH and a node NA. The resistor R2 is connected between the node NA and a ground voltage VSS. A voltage level of the node NA is set to a first gate-on voltage VONN voltage-divided by the resistors R1 and R2. Therefore, the second gate-on voltage VONH has a voltage level higher than that of the first gate-on voltage VONN. For example, when the first gate-on voltage VONN is about 26 volts, the second gate-on voltage VONH may be about 28 volts. The voltage levels of the first and second gate-on voltages VONN and VONH are not limited thereto. The portion of the level shifter 220 that includes the voltage divider 222 that provides the first gate-on voltage VONN to the gate-on voltage selector 224, and the node that provides the second gate-on voltage VONH to the gate-on voltage selector 224, may be referred to as a voltage generator.

The gate-on voltage selector 224 outputs either the first gate-on voltage VONN or the second gate-on voltage VONH as the gate-on voltage VON in response to the gate-on control signal VON_CTRL, which is provided to the gate-on voltage selector 224 by the timing controller 210, as shown in FIG. 2.

The gate clock generator 226 receives the gate-on voltage VON and the gate-off voltage VOFF, and outputs the first and second gate clock signals CKV and CKVB in response to the gate pulse signal CPV provided from the timing controller 210, as shown in FIG. 2.

Figure 4:
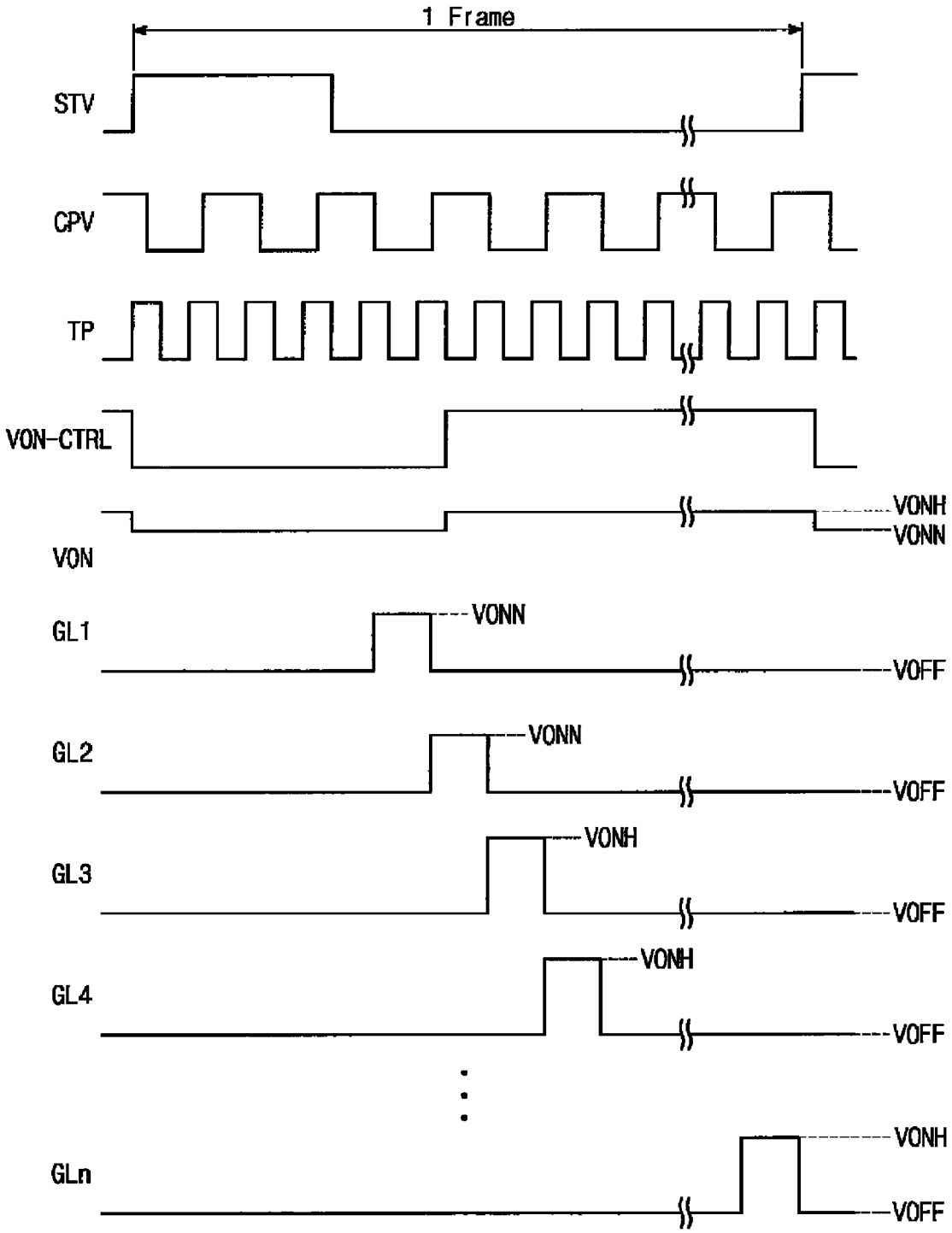
FIG. 4 is a timing diagram showing signals used in the level shifter shown in FIG. 3, according to an exemplary embodiment of the present disclosure.

FIG. 4 is a timing diagram showing signals used in the level shifter shown in FIG. 3, according to an exemplary embodiment of the present disclosure. In the exemplary embodiment described with reference to FIG. 4, the light sources 174 of the backlight unit 170 are arranged adjacent to the side of the display panel 120 at which the first gate line GL1 is disposed.

Referring to FIG. 4, the gate lines GL1 to GLn are sequentially scanned in one frame. The timing controller 210 shown in FIG. 2 outputs the gate-on control signal VON_CTRL at a low level during a predetermined time period after the vertical synchronization start signal STY is activated, and outputs the gate-on control signal VON_CTRL at a high level after the predetermined time period lapses. Herein, when a signal, such as the gate-on control signal VON_CTRL is referred to as being activated, the signal is at a high level. For example, as shown in FIG. 4, the timing controller 210 outputs the gate-on control signal VON_CTRL at the high level in synchronization with a sixth pulse of a line latch signal TP after the vertical synchronization start signal STV is activated. Therefore, the voltage level of the gate-on voltage VON of two gate lines GL1 and GL2 adjacent to the light sources 174 is set to the first gate-on voltage VONN, and the voltage level of the gate-on voltage VON of other gate lines GL3 to GLn is set to the second gate-on voltage VONH.

When the light sources 174 are disposed adjacent to the first gate line GL 1 in the display device 100 shown in FIGS. 1 and 2, a hot spot may occur. A hot spot refers to an area of the display device 100 in which the displayed image is more brightly perceived compared to other areas of the display device 100. A hot spot may occur in an area of the display device 100 that is closer to the light sources 174 than other areas of the display device 100. In an exemplary embodiment, the voltage level of the gate-on voltage VON used to drive the gate lines GL1 and GL2 of the display panel 120 is set to the first gate-on voltage VONN, and the voltage level the gate-on voltage VON used to drive other gate lines GL3 to GLn is set to the second gate-on voltage VONH. When the voltage level of the gate-on voltage VON used to drive the gate lines GL1 and GL2 disposed closest to the light sources 174 (e.g., the gate line(s) adjacent to the light sources 174) is set to the first gate-on voltage VONN, which is lower than the second gate-on voltage VONH, a charge rate of the liquid crystal capacitor CLC in each pixel PXL is decreased. When the charge rate of the liquid crystal capacitor CLC in each pixel PXL connected to the gate lines GL1 and GL2 is decreased, the brightness of the pixels PX connected to the gate lines GL1 and GL2 may be lowered. As a result, the hot spot may not be perceived, or the appearance of the hot spot may be reduced.

Although exemplary embodiments described herein include setting the voltage level of the gate-on voltage VON of the two gate lines GL1 and GL2 disposed adjacent to the light sources 174 as the first gate-on voltage VONN, the number of gate lines that the first gate-on voltage VONN is applied to is not limited to only the gate lines disposed closest to (e.g., adjacent) to the light sources 174. For example, the number of gate lines to which the voltage level of the gate-on voltage VON is set to the first gate-on voltage VONN may be changed according to the area(s) in which the hot spot occurs.

For example, according to an exemplary embodiment, the gate-on control signal VON-CTRL is activated while a portion of the gate lines disposed closest to the backlight unit 170 is activated. This portion of the gate lines may include, fore example, gate lines GL1 and GL2, as described herein. This portion may also include additional gate lines closest to the backlight unit 170. The level shifter 220 outputs the first gate-on voltage VONN as the gate-on voltage VON while the gate-on control signal VON_CTRL is activated, and outputs the second gate-on voltage VONH as the gate-on voltage VON while the gate-on control signal VON_CTRL is not activated.

Figure 5:
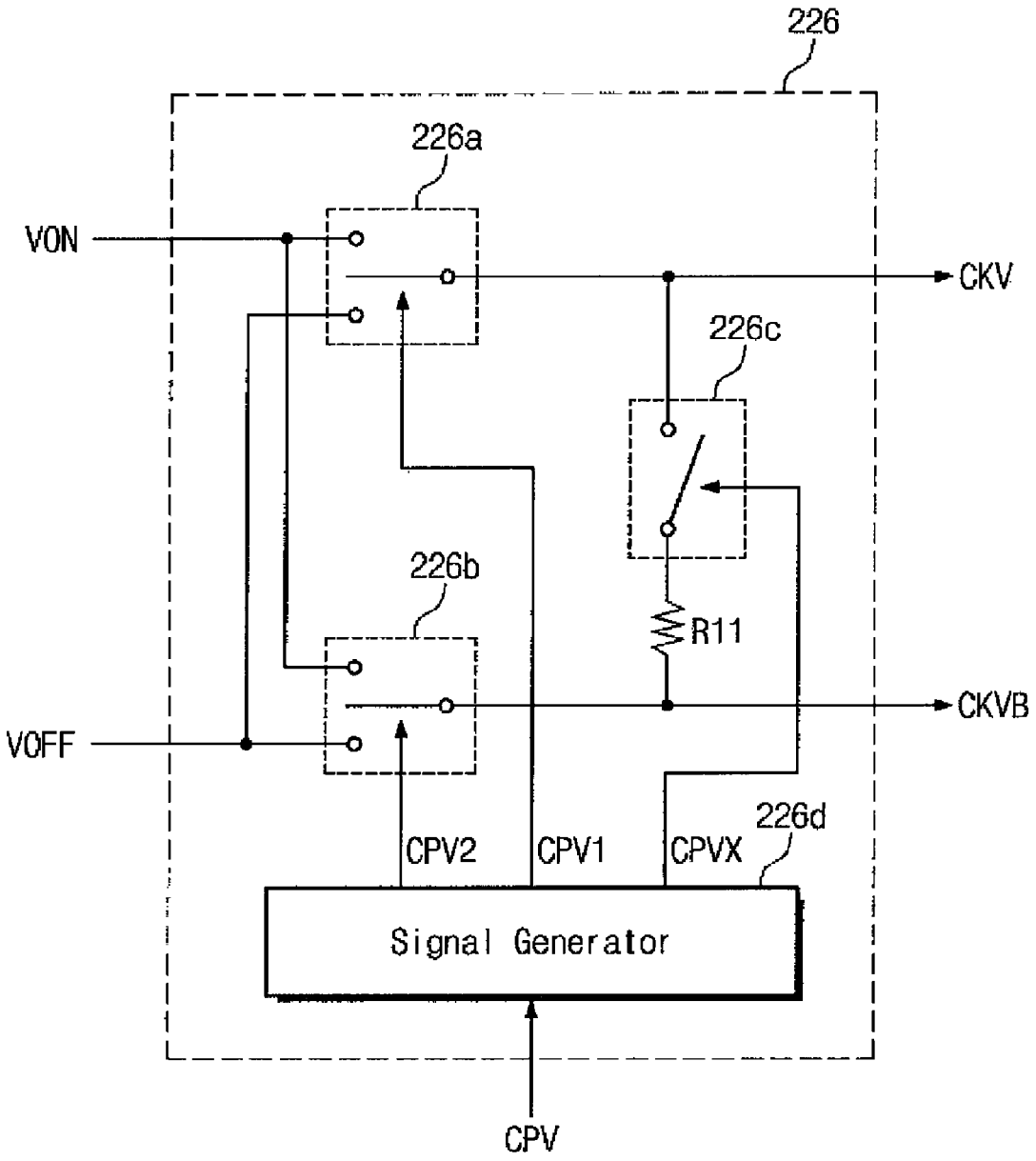
FIG. 5 is a block diagram showing a gate clock generator shown in FIG. 3, according to an exemplary embodiment of the present disclosure.

FIG. 5 is a block diagram showing the gate clock generator shown in FIG. 3, according to an exemplary embodiment of the present disclosure.

Referring to FIG. 5, the gate clock generator 226 includes switching circuits 226*a*, 226*b*, and 226*c*, a resistor R11, and a signal generator 226*d*. The signal generator 226*d* generates a first gate pulse signal CPV1, a second gate pulse signal CPV2, and a charge share signal CPVX in response to the gate pulse signal CPV provided from the timing controller 210, as shown in FIG. 2.

The switching circuit 226*a* outputs either the gate-on voltage VON or the gate-off voltage VOFF as the first gate clock signal CKV in response to the first gate pulse signal CPV1. The switching circuit 226*b* outputs either the gate-on voltage VON or the gate-off voltage VOFF as the second gate clock signal CKVB in response to the second gate pulse signal CPV2. The switching circuit 226*c* and the resistor R11 are connected in series between a node from which the first gate clock signal CKV is output and a node from which the second gate clock signal CKVB is output. The switching circuit 226*c* electrically connects the node from which the first gate clock signal CKV is output and the node from which the second gate clock signal CKVB is output in response to the charge share signal CPVX.

Figure 6:
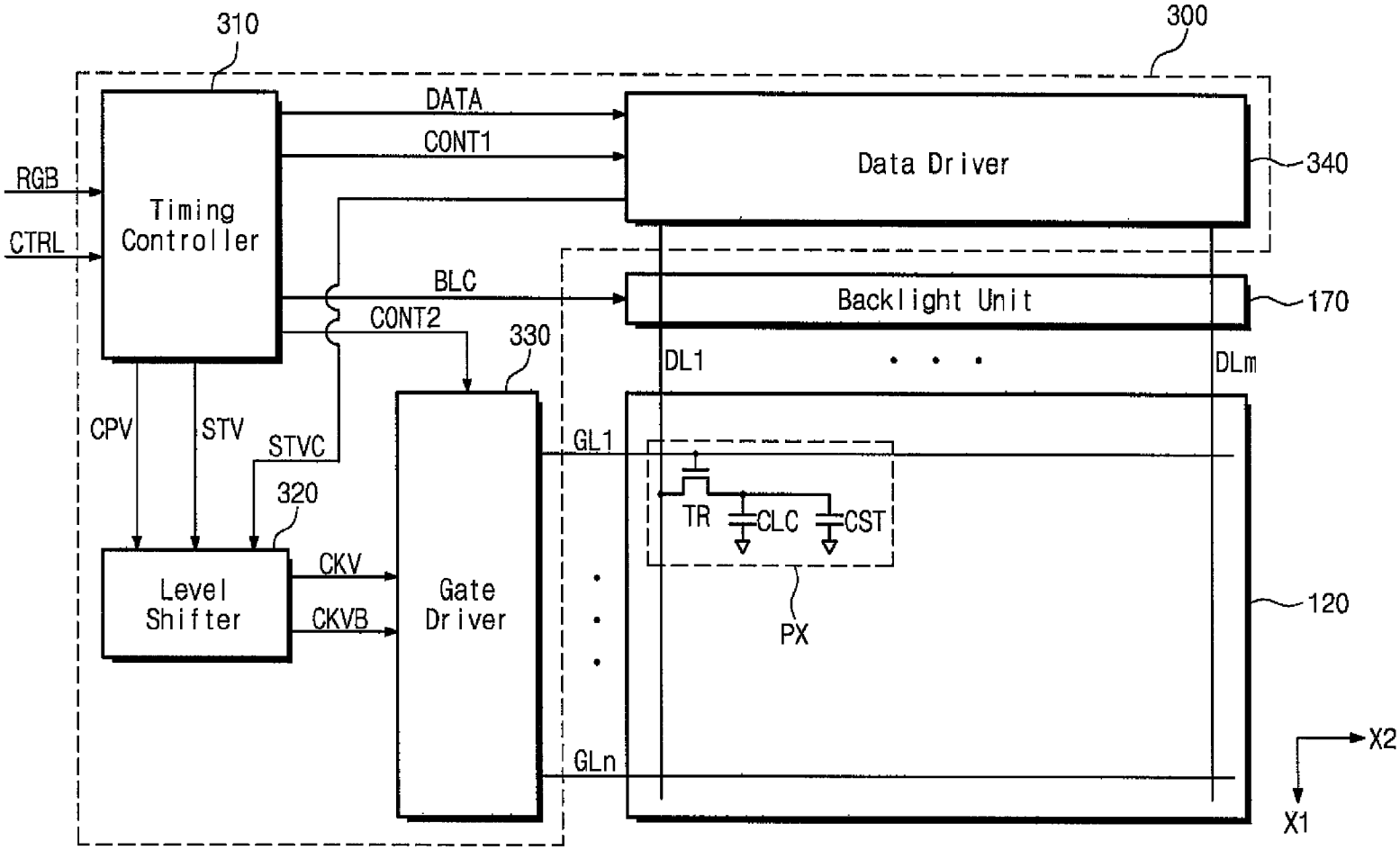
FIG. 6 is a block diagram showing a display panel, a driving circuit, and a backlight unit of the display device, according to an exemplary embodiment of the present disclosure.

FIG. 6 is a block diagram showing a display panel, a driving circuit, and a backlight unit of the display device, according to an exemplary embodiment of the present disclosure. In FIG. 6, the same reference numerals may denote the same elements as in FIG. 2, and a detailed description of the same elements may be omitted. A driving circuit 300 includes a timing controller 310, a level shifter 320, a gate driver 330, and a data driver 340.

The timing controller 310 receives image signals RGB and control signals CTRL. The control signals CTRL may include, for example, a vertical synchronization signal, a horizontal synchronization signal, a main clock signal, a data enable signal, etc., and are used to control the image signals RGB. The timing controller 310 converts the image signals RGB to image data signal DATA, which is in a format that can be used by the display panel 120, based on the control signals CTRL. The timing controller 310 applies the image data signal DATA and a first control signal CONT1 to the data driver 340, and applies a second control signal CONT2 to the gate driver 330. In the exemplary embodiment shown in FIG. 6, the first control signal CONT1 includes a horizontal synchronization start signal, a clock signal, a polarity inversion signal, and a line latch signal, and the second control signal CONT2 includes a vertical synchronization start signal, an output enable signal, and a gate pulse signal CPV. The timing controller 310 may convert the image data signal DATA in various manners in accordance with the arrangement of the pixels PX and a display frequency of the display panel 120. The timing controller 310 applies the gate pulse signal CPV to the level shifter 320, and applies the backlight control signal BLC to the backlight unit 170. The timing controller 310 further applies the vertical synchronization start signal STV to the level shifter 320.

The gate driver 330 drives the gate lines GL1 to GLn in response to the second control signal CONT2 received from the timing controller 310, and the first and second gate clock signals CKV and CKVB received from the level shifter 320. The gate driver 330 includes a gate driver integrated circuit. According to an exemplary embodiment, the gate driver 330 is configured in a circuit using an amorphous silicon gate thin-film transistor (a-Si TFT), an oxide semiconductor, a crystalline semiconductor, or a polycrystalline semiconductor. In this case, the gate driver 330 is directly integrated on the lower display substrate 122 without being mounted on the lower display substrate 122. In an exemplary embodiment, the gate driver 330 may be separate from, and mounted on the lower display substrate 122.

The data driver 340 drives the data lines DL1 to DLm in response to the image data signal DATA and the first control signal CONT1 received from the timing controller 310. In addition, the data driver 340 applies a gate-on control signal STVC to the level shifter 320.

The level shifter 320 generates the first gate clock signal CKV and the second gate clock signal CKVB in response to the gate pulse signal CPV received from the timing controller 310 and the gate-on control signal STVC received from the data driver 340. Each of the first and second gate clock signals CKV and CKVB has the gate-on voltage level and the gate-off voltage level. The gate-on voltage level may be set by the gate pulse signal CPV and the gate-on control signal STVC.

Figure 7:
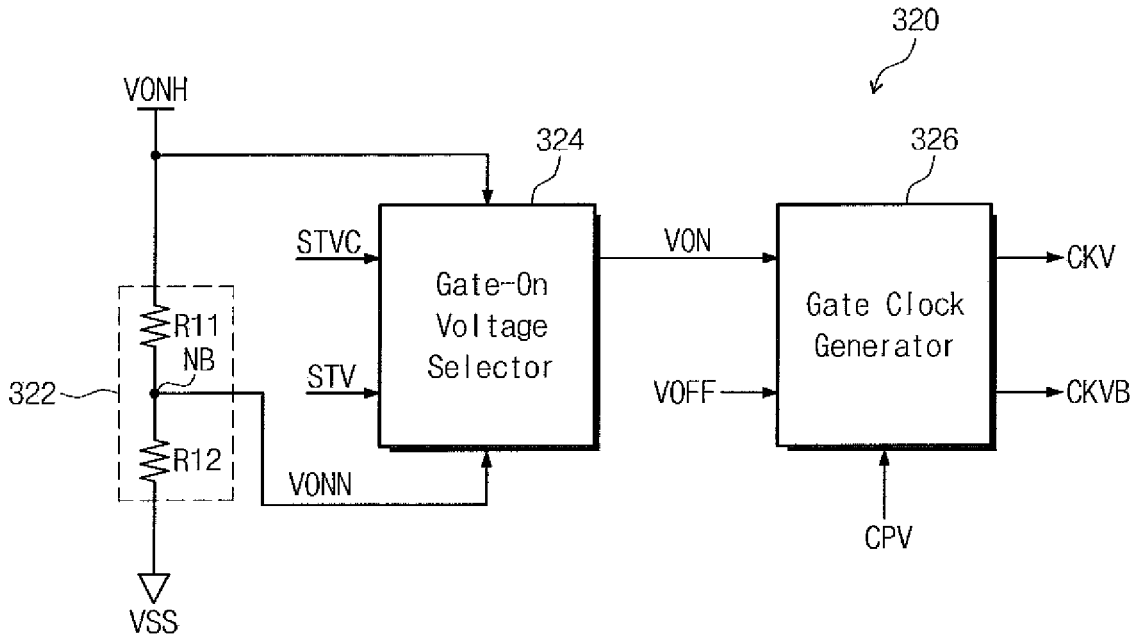
FIG. 7 is a block diagram showing a level shifter shown in FIG. 6, according to an exemplary embodiment of the present disclosure.

FIG. 7 is a block diagram showing the level shifter shown in FIG. 6, according to an exemplary embodiment of the present disclosure.

Referring to FIG. 7, the level shifter 320 includes a voltage divider 322, a gate-on voltage selector 324, and a gate clock generator 326. The voltage divider 322 includes resistors R11 and R12. The resistor R11 is connected between a second gate-on voltage VONH and a node NB. The resistor R12 is connected between the node NB and a ground voltage VSS. A voltage level of the node NB is set to a first gate-on voltage VONN voltage-divided by the resistors R11 and R12. Therefore, the second gate-on voltage VONH has a voltage level higher than that of the first gate-on voltage VONN. For example, when the first gate-on voltage VONN is about 26 volts, the second gate-on voltage VONH may be about 28 volts. The voltage levels of the first and second gate-on voltages VONN and VONH are not limited thereto.

The gate-on voltage selector 324 outputs one of the first gate-on voltage VONN and the second gate-on voltage VONH as the gate-on voltage VON in response to the vertical synchronization start signal STV provided from the timing controller 310, and the gate-on control signal STVC provided from the data driver 340, as shown in FIG. 6.

The gate clock generator 326 receives the gate-on voltage VON and the gate-off voltage VOFF and outputs the first and second gate clock signals CKV and CKVB in response to the gate pulse signal CPV provided from the timing controller 310, as shown in FIG. 6.

Figure 8:
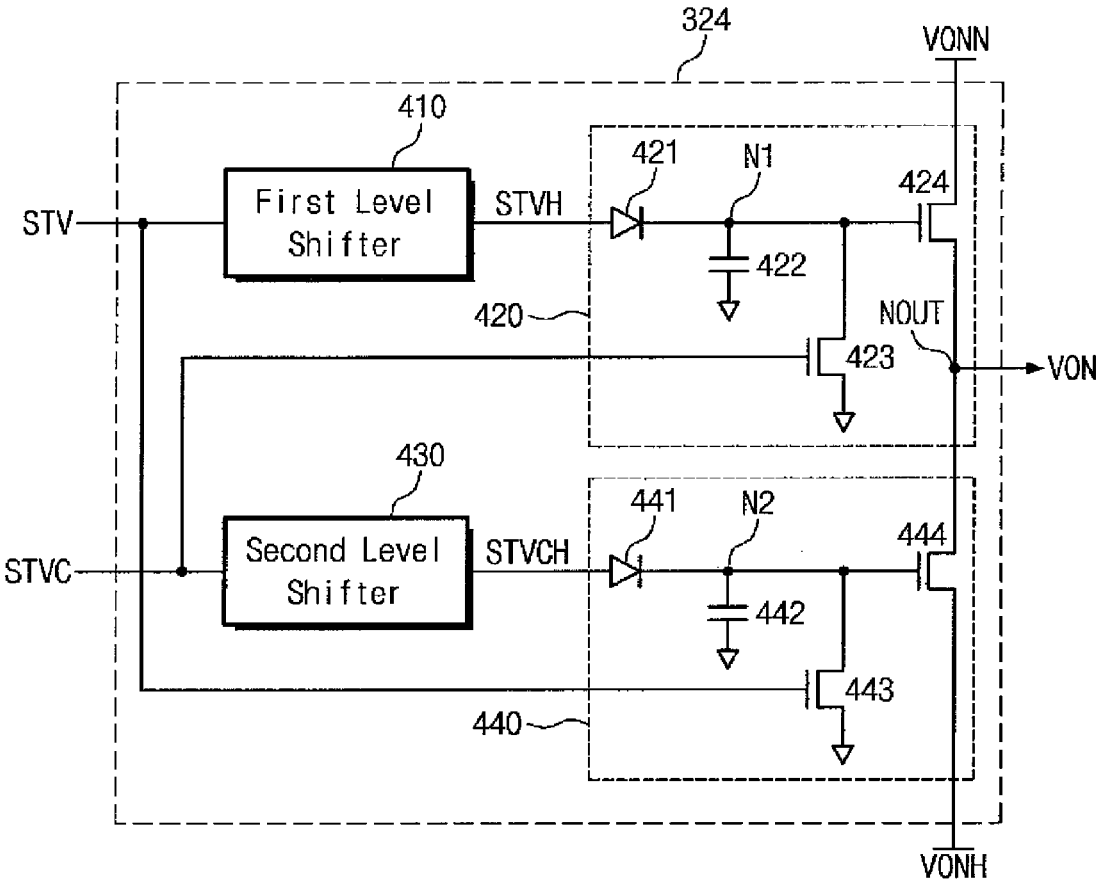
FIG. 8 is a circuit diagram showing a gate-on voltage selector shown in FIG. 7, according to an exemplary embodiment of the present disclosure.

FIG. 8 is a circuit diagram showing the gate-on voltage selector shown in FIG. 7, according to an exemplary embodiment of the present disclosure.

Referring to FIG. 8, the gate-on voltage selector 324 includes a first level shifter 410, a first output circuit 420, a second level shifter 430, and a second output circuit 440.

The first level shifter 410 boosts the vertical synchronization start signal STV and outputs the boosted vertical synchronization start signal STVH. The first output circuit 420 includes a diode 421, a capacitor 422, and transistors 423 and 424. The diode 421 is connected between the boosted vertical synchronization start signal STVH and a first node N1. The capacitor 422 is connected between the first node N1 and the ground voltage. The transistor 423 is connected between the first node N1 and the ground voltage, and includes a gate terminal connected to the gate-on control signal STVC. The transistor 424 is connected between the first gate-on voltage VONN and an output node NOUT and includes a gate terminal connected to the first node N1.

The second level shifter 430 boosts the gate-on control signal STVC and outputs the boosted gate-on control signal STVCH. The second output circuit 440 includes a diode 441, a capacitor 442, and transistors 443 and 444. The diode 441 is connected between the boosted gate-on control signal STVCH and a second node N2. The capacitor 442 is connected between the second node N2 and the ground voltage. The transistor 443 is connected between the second node N2 and the ground voltage and includes a gate terminal connected to the vertical synchronization start signal STV. The transistor 444 is connected between the second gate-on voltage VONH and the output node NOUT and includes a gate terminal connected to the second node N2.

The operation of the gate-on voltage selector 324 is as follow.

When the vertical synchronization start signal STV, which indicates a start of one frame, is activated to the high level, the first level shifter 410 outputs the boosted vertical synchronization start signal STVH. When a voltage level of the first node N1 is increased to the level of the boosted vertical synchronization start signal STVH through the diode 421, the transistor 424 is turned on and the first gate-on voltage VONN is applied to the output node NOUT. As a result, the gate-on voltage VON is set to the level of the first gate-on voltage VONN. In this case, the gate-on control signal STVC is maintained at the low level and the transistor 423 is maintained in a turned-off state, and the voltage level of the first node N1 is maintained at the level of the boosted vertical synchronization start signal STVH by the capacitor 422.

When a predetermined time period lapses after the vertical synchronization start signal STV is activated to the high level, the gate-on control signal STVC transitions to the high level. The transistor 423 of the first output circuit 420 is turned on, the voltage level of the first node N1 is discharged to the ground voltage level, and the transistor 424 is turned off. Further, the second level shifter 430 outputs the boosted gate-on control signal STVCH in response to the transition of the gate-on control signal STVC to the high level. When the voltage level of the second node N2 is increased to the level of the boosted gate-on control signal STVCH through the diode 441, the transistor 444 is turned on and the second gate-on voltage VONH is applied to the output node NOUT. As a result, the gate-on voltage VON is set to the level of the second gate-on voltage VONH. In this case, the vertical synchronization start signal STV is maintained at the low level and the transistor 443 is maintained in the turned-off state. Thus, the voltage level of the second node N2 may be maintained at the level of the boosted gate-on control signal STVCH by the capacitor 442.

Figure 9:
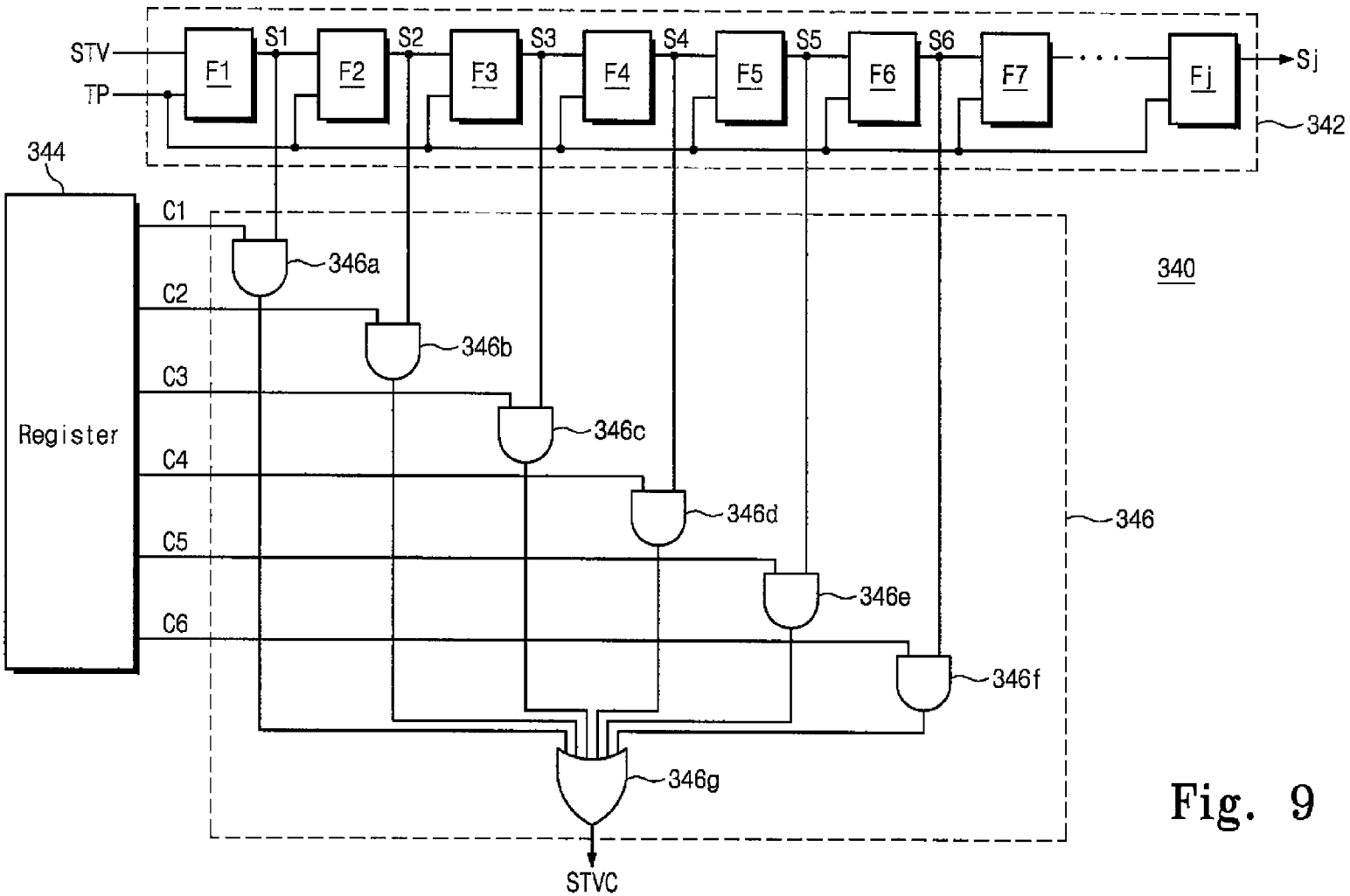
FIG. 9 is a view showing the configuration and operation of a data driver shown in FIG. 6, according to an exemplary embodiment of the present disclosure.

FIG. 9 is a view showing the configuration and operation of the data driver shown in FIG. 6, according to an exemplary embodiment of the present disclosure. For example, FIG. 9 shows the configuration of the data driver 340 relating to the generation of the gate-on control signal STVC.

Referring to FIG. 9, the data driver 340 includes a shift register 342, a register 344, and a logic circuit 346. The shift register 342 outputs a plurality of latch signals S1 to Sj in response to the vertical synchronization start signal STV and the line latch signal TP included in the first control signal CONT1, which is provided from the timing controller 310. The register 344 stores gate-on information signals C1 to C6. The logic circuit 346 outputs the gate-on control signal STVC in response to some of the latch signals S1 to Sj (e.g., S1 to S6 of the latch signals S1 to Sj) received from the shift register 342 and the gate-on information signals C1 to C6 received from the register 344.

The shift register 342 includes a plurality of flip-flops F1 to Fj. The flip-flops F1 to Fj are connected to each other in series. A first flip-flop F1 receives the vertical synchronization start signal STV, and a k-th flip-flop Fk receives the latch signal Sk-1 from a (k−1)th flip-flop Fk-1. k is a positive integer greater than 1 and less than or equal to j (e.g., $1<k\leq j$). Each of the flip-flops F1 to Fj is operated in synchronization with the line latch signal TP.

The logic circuit 346 includes AND gates 346*a* to 3461 and an OR gate 346*g*. Each of the AND gates 346*a* to 346*f* receives a corresponding latch signal of the latch signals S1 to S6 from the flip-flops F1 to F6 and a corresponding gate-on information signal of the gate-on information signals C1 to C6 received from the register 344. The OR gate

346*g* receives output signals from the AND gates 346*a* to 346*f* and outputs the gate-on control signal STVC.

For example, when the gate-on information signals C1 to C6 stored in the register 344 are "000001", the data driver 340 activates the gate-on control signal STVC to the high level when the latch signal S6 output from the sixth flip-flop F6 of the shift register 342 is output at the high level after the vertical synchronization start signal STV is activated to the high level.

In the exemplary embodiment shown in FIG. 9, the gate-on information signals C1 to C6 are stored in the register 344, but they are not limited thereto. For example, the gate-on information signals C1 to C6 may be directly provided from the timing controller 310 or provided through a connection of a pull-up resistor and a fuse.

Figure 10:
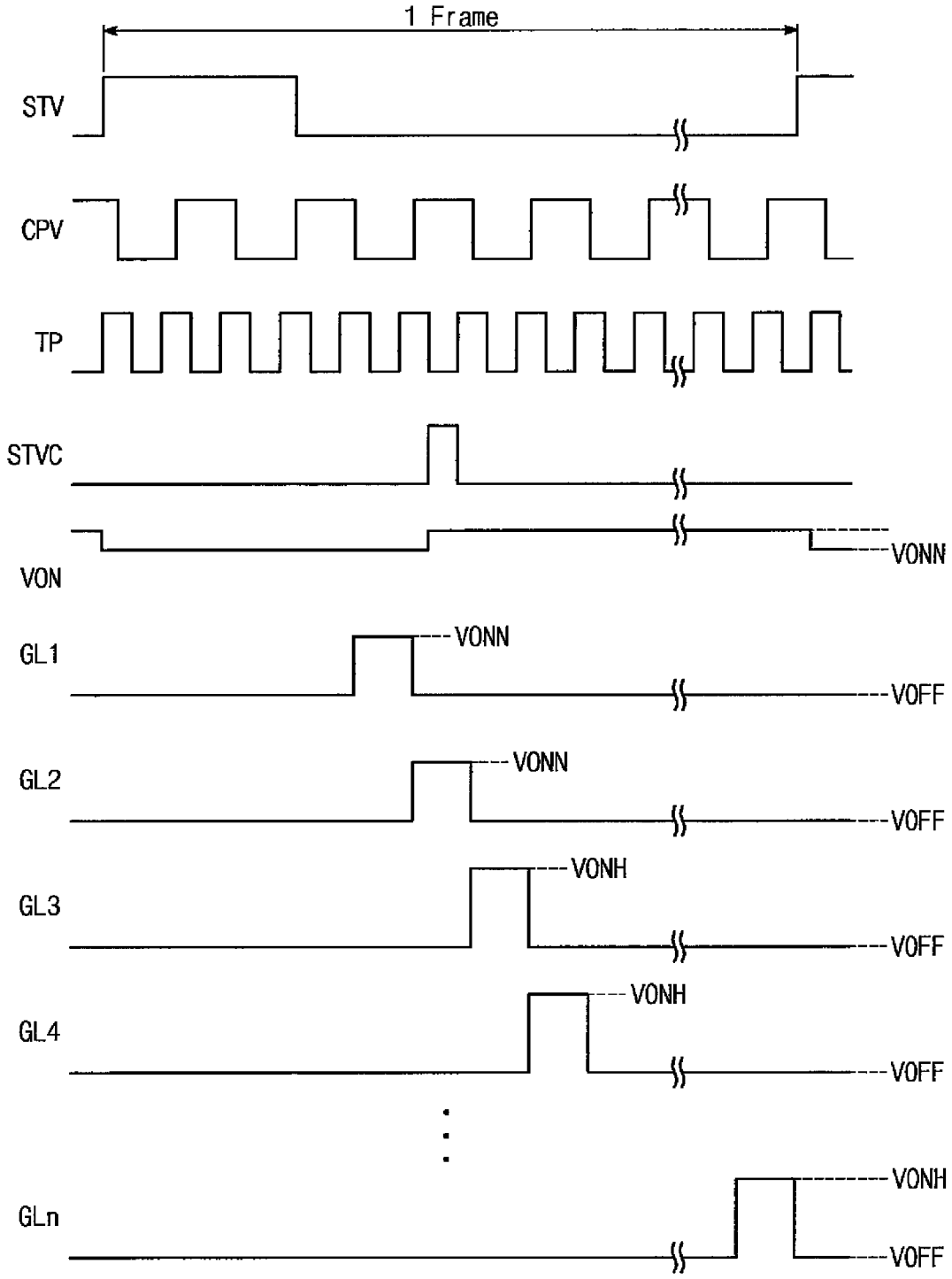
FIG. 10 is a timing diagram showing an operation of the data driver shown in FIG. 6, according to an exemplary embodiment of the present disclosure.

FIG. 10 is a timing diagram showing an operation of the data driver shown in FIG. 6, according to an exemplary embodiment of the present disclosure.

Referring to FIGS. 6 to 10, when the vertical synchronization start signal STV is activated to the high level, the transistor 424 of the gate-on voltage selector 324 is turned on, and thus, the voltage level of the gate-on voltage VON is set to the first gate-on voltage VONN. When the gate-on control signal STVC received from the data driver 340 is activated to the high level after the predetermined time period lapses, the transistor 444 of the gate-on voltage selector 324 is turned on, and the voltage level of the gate-on voltage VON is set to the second gate-on voltage VONH.

Since the voltage level of the gate-on voltage VON used to drive the gate lines GL1 and GL2 disposed adjacent to the light sources 174 is set to the first gate-on voltage VONN, which is lower than the second gate-on voltage VONH, a charge rate of the liquid crystal capacitor CLC in each pixel PXL is decreased. When the charge rate of the liquid crystal capacitor CLC in each pixel PXL connected to the gate lines GL1 and GL2 is decreased, the brightness of the pixels PX connected to the gate lines GL1 and GL2 is lowered. As a result, a hot spot may be eliminated, or the appearance of a hot spot may be reduced.

In the exemplary embodiment described with reference to FIGS. 6 to 10, the voltage level of the gate-on voltage VON of the two gate lines GL1 and GL2 disposed closest to (e.g., adjacent to) the light sources 174 is set to the first gate-on voltage VONN. However, the number of the gate lines at which the voltage level of the gate-on voltage VON is set to the first gate-on voltage VONN is not limited thereto. That is, the number of the gate lines at which the voltage level of the gate-on voltage VON is set to the first gate-on voltage VONN may be changed based on the area(s) in which a hot spot(s) occurs.

Figure 11:
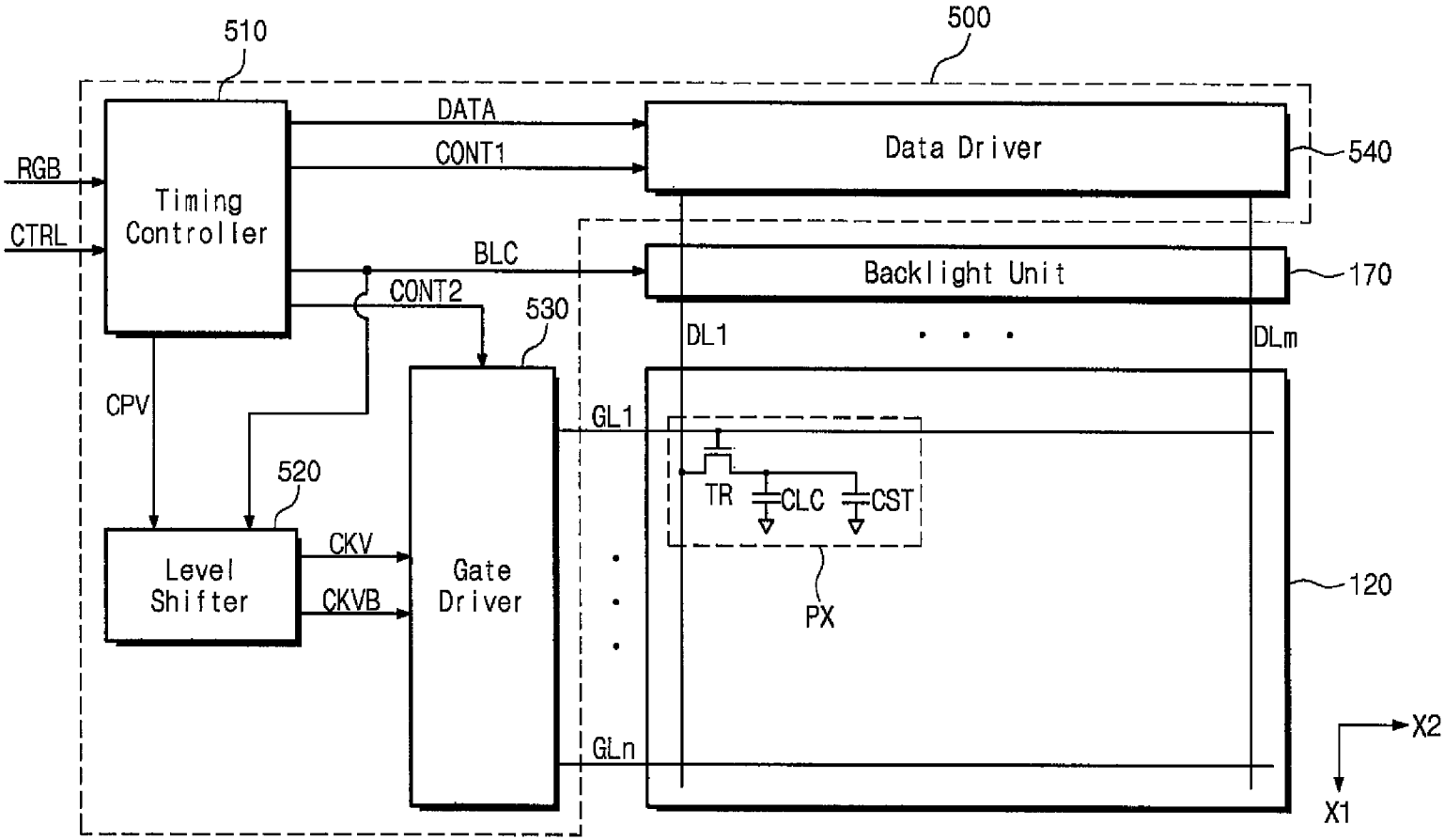
FIG. 11 is a block diagram showing a display panel, a driving circuit, and a backlight unit of the display device, according to an exemplary embodiment of the present disclosure.

FIG. 11 is a block diagram showing a display panel, a driving circuit, and a backlight unit of the display device, according to an exemplary embodiment. In FIG. 11, the same reference numerals may denote the same elements as in FIG. 6, and a detailed description of the same elements may be omitted. A driving circuit 500 includes a timing controller 510, a level shifter 520, a gate driver 530, and a data driver 540.

The timing controller 510 receives image signals RGB and control signals CTRL. The control signals CTRL may include, for example, a vertical synchronization signal, a horizontal synchronization signal, a main clock signal, a data enable signal, etc., and are used to control the image signals RGB. The timing controller 510 converts the image signals RGB to image data signal DATA which is in a format that can be used by the display panel 120, based on the control signals CTRL. The timing controller 510 applies the image data signal DATA and a first control signal CONT1 to the data driver 540, and applies a second control signal CONT2 to the gate driver 530. In the exemplary embodiment shown in FIG. 11, the first control signal CONT1 includes a horizontal synchronization start signal, a clock signal, a polarity inversion signal, and a line latch signal, and the second control signal CONT2 includes a vertical synchronization start signal, an output enable signal, and a gate pulse signal CPV. The timing controller 510 may convert the image data signal DATA in various manners in accordance with the arrangement of the pixels PX and a display frequency of the display panel 120. The timing controller 510 applies the gate pulse signal CPV and the backlight control signal BLC to the level shifter 520, and applies the backlight control signal BLC to the backlight unit 170.

The gate driver 530 drives the gate lines GL1 to GLn in response to the second control signal CONT2 received from the timing controller 510, and the first and second gate clock signals CKV and CKVB received from the level shifter 520. The gate driver 530 includes a gate driver integrated circuit. According to an exemplary embodiment, the gate driver 530 is configured in a circuit using an amorphous silicon gate thin-film transistor (a-Si TFT), an oxide semiconductor, a crystalline semiconductor, or a polycrystalline semiconductor. In this case, the gate driver 530 is directly integrated on the lower display substrate 122 without being mounted on the lower display substrate 122. In an exemplary embodiment, the gate driver 530 may be separate from, and mounted on the lower display substrate 122.

The data driver 540 drives the data lines DL1 to DLm in response to the image data signal DATA and the first control signal CONT1 received from the timing controller 510.

The level shifter 520 generates the first gate clock signal CKV and the second gate clock signal CKVB in response to the gate pulse signal CPV and the backlight control signal BLC received from the timing controller 510. Each of the first and second gate clock signals CKV and CKVB has the gate-on voltage level and the gate-off voltage level. The gate-on voltage level may be set by the gate pulse signal CPV and the backlight control signal BLC.

Figure 12:
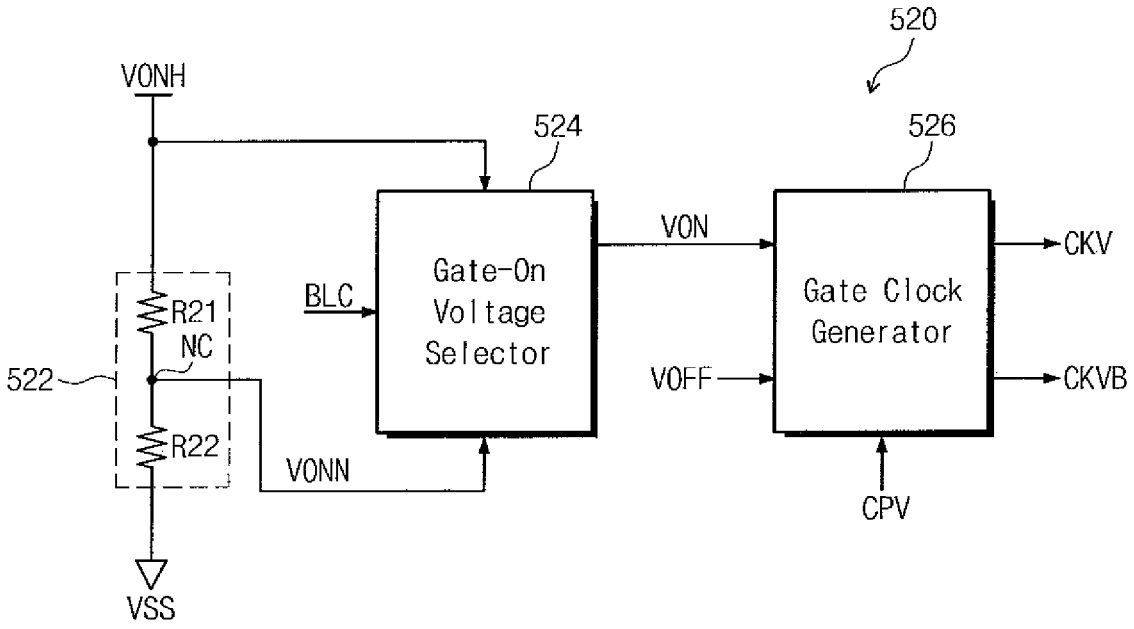
FIG. 12 is a block diagram showing a level shifter shown in FIG. 11, according to an exemplary embodiment of the present disclosure.

FIG. 12 is a block diagram showing the level shifter shown in FIG. 11, according to an exemplary embodiment of the present disclosure.

Referring to FIG. 12, the level shifter 520 includes a voltage divider 522, a gate-on voltage selector 524, and a gate clock generator 526. The voltage divider 522 includes resistors R21 and R22. The resistor R21 is connected between a second gate-on voltage VONH and a node NC. The resistor R22 is connected between the node NC and a ground voltage VSS. A voltage level of the node NC is set to a first gate-on voltage VONN voltage-divided by the resistors R21 and R22. Therefore, the second gate-on voltage VONH has a voltage level higher than that of the first gate-on voltage VONN. For example, when the first gate-on voltage VONN is about 28 volts, the second gate-on voltage VONH may be about 32 volts. The voltage levels of the first and second gate-on voltages VONN and VONH are not limited thereto.

The gate-on voltage selector 524 outputs one of the first gate-on voltage VONN and the second gate-on voltage VONH as the gate-on voltage VON in response to the backlight control signal BLC provided from the timing controller 510, as shown in FIG. 11.

The gate clock generator 526 receives the gate-on voltage VON and the gate-off voltage VOFF and outputs the first and second gate clock signals CKV and CKVB in response to the gate pulse signal CPV provided from the timing controller 510, as shown in FIG. 11.

Figure 13:
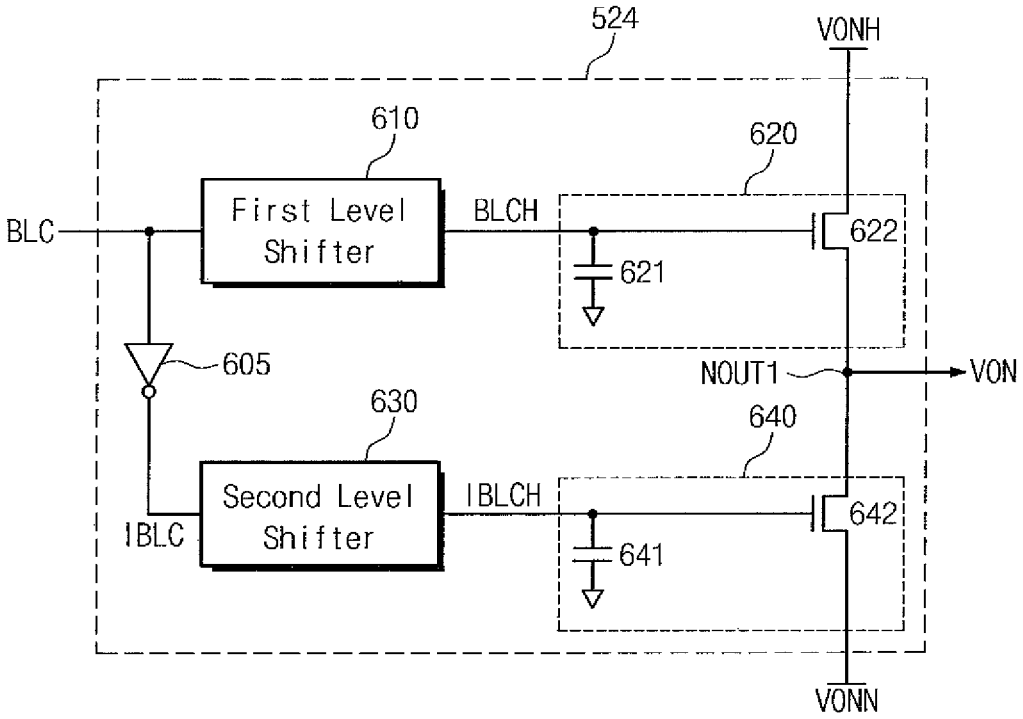
FIG. 13 is a circuit diagram showing a gate-on voltage selector shown in FIG. 12, according to an exemplary embodiment of the present disclosure.

FIG. 13 is a circuit diagram showing the gate-on voltage selector shown in FIG. 12, according to an exemplary embodiment of the present disclosure.

Referring to FIG. 13, the gate-on voltage selector 524 includes an inverter 605, a first level shifter 610, a first output circuit 620, a second level shifter 630, and a second output circuit 640.

The first level shifter 610 boosts the backlight control signal BLC and outputs the boosted backlight control signal BLCH. The first output circuit 620 includes a capacitor 621 and a transistor 622. The capacitor 621 is connected between an output terminal of the first level shifter 610 and the ground voltage. The transistor 622 is connected between the second gate-on voltage VONH and an output node NOUT1 and includes a gate terminal connected to the boosted backlight control signal BLCH.

The inverter 605 inverts the backlight control signal BLC and outputs the inverted backlight control signal IBLC.

The second level shifter 630 boosts the inverted backlight control signal IBLC and outputs the boosted and inverted backlight control signal IBLCH. The second output circuit 640 includes a capacitor 641 and a transistor 642. The capacitor 641 is connected between an output terminal of the second level shifter 630 and the ground voltage. The transistor 642 is connected between the first gate-on voltage VONN and the output node NOUT1 and includes a gate terminal connected to the boosted and inverted backlight control signal IBLCH.

The operation of the gate-on voltage selector 524 is further described with reference to FIG. 14.

Figure 14:
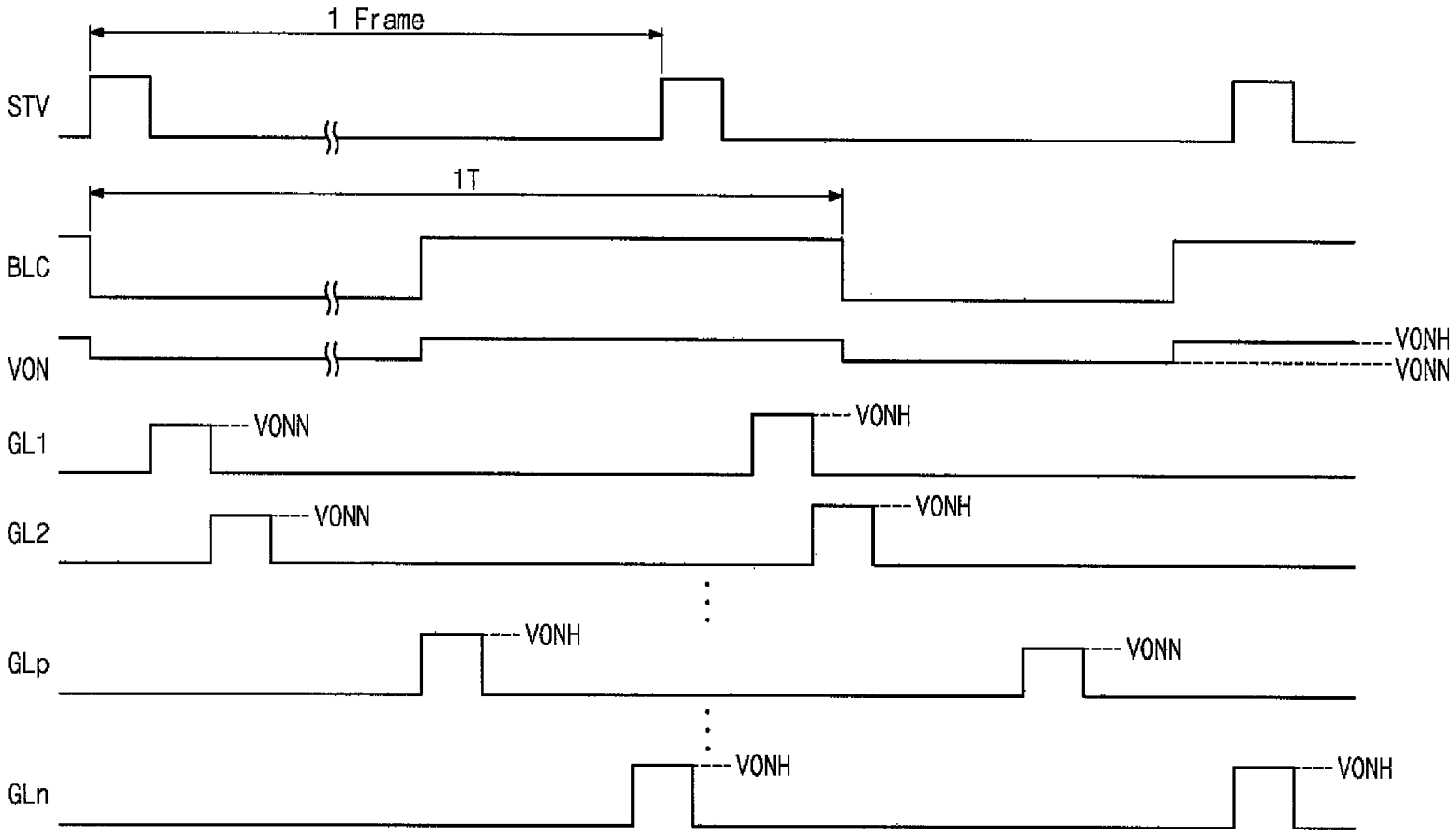
FIG. 14 is a timing diagram showing an operation of a gate-on voltage selector shown in FIG. 13, according to an exemplary embodiment of the present disclosure.

FIG. 14 is a timing diagram showing an operation of the gate-on voltage selector shown in FIG. 13, according to an exemplary embodiment of the present disclosure.

Referring to FIGS. 13 and 14, in a case in which a frequency of the vertical synchronization start signal STV is different from a frequency of the backlight control signal BLC, the turn-on and turn-off timing of the light sources 174 is changed in each frame. A parasitic capacitance applied to the liquid crystal capacitor CLC of each pixel PXL during the turn-on time of the light sources 174 is different from a parasitic capacitance applied to the liquid crystal capacitor CLC of each pixel PXL during the turn-off time of the light sources 174. Therefore, when a point in time at which a difference between voltages applied to both ends of the pixel PXL occurs is changed at every frame due to the variation of the turn-on and turn-off timing of the light sources 174, a waterfall noise effect, in which the brightness of the image displayed on the display panel 120 is varied at predetermined numbers of lines, may occur.

When the backlight control signal BLC is activated to the high level, the first level shifter 610 outputs the boosted backlight control signal BLCH. The transistor 622 is turned on in response to the boosted backlight control signal BLCH, and the second gate-on voltage VONH is applied to the output node NOUT1. Therefore, the voltage level of the gate-on voltage VON is set to the level of the second gate-on voltage VONH.

When the backlight control signal BLC transitions to the low level, the second level shifter 630 outputs the boosted and inverted backlight control signal IBLCH. The transistor 642 is turned on in response to the boosted and inverted backlight control signal IBLCH, and the first gate-on voltage VONN is applied to the output node NOUT1. Thus, the voltage level of the gate-on voltage VON is set to the level of the first gate-on voltage VONN.

The level shifter 520 sets the voltage level of the gate-on voltage VON to the voltage level of the second gate-on voltage VONH, which is higher than the voltage level of the first gate-on voltage VONN, while the backlight control signal BLC is maintained at the high level. As a result, the brightness of the image displayed on the display panel 120 may increase. On the contrary; the level shifter 520 sets the voltage level of the gate-on voltage VON to the voltage level of the first gate-on voltage VONN while the backlight control signal BLC is maintained at the low level. As a result, the brightness of the image displayed on the display panel 120 may decrease. Thus, the waterfall noise effect that may occur when the frequency of the vertical synchronization start signal STV is different from the frequency of the backlight control signal BLC may be prevented or reduced.

While the present invention has been particularly shown and described with reference to the exemplary embodiments thereof, it will be understood by those of ordinary skill in the art that various changes in form and detail may be made therein without departing from the spirit and scope of the present invention as defined by the following claims.

What is claimed is:

1. A display device, comprising:

a display panel comprising a plurality of gate lines, a plurality of data lines, and a plurality of pixels, wherein each pixel is connected to a corresponding gate line of the gate lines and a corresponding data line of the data lines;

a gate driver configured to drive the gate lines;

a level shifter configured to apply a gate clock signal to the gate driver;

a data driver configured to drive the data lines;

a timing controller configured to generate a gate-on control signal and a plurality of control signals that control the level shifter, the gate driver, and the data driver; and a backlight unit configured to provide a light to the display panel, wherein the level shifter is configured to set a voltage level of a gate-on voltage of the gate clock signal to a voltage level of a first gate-on voltage or a voltage level of a second gate-on voltage in response to the gate-on control signal, wherein the voltage level of the second gate-on voltage is higher than the voltage level of the first gate-on voltage, wherein, during one frame, the first gate-on voltage is applied as the gate-on voltage to a portion of the gate lines disposed closest to the backlight unit, and the second gate-on voltage is applied as the gate-on voltage to gate lines other than the portion of the gate lines disposed closest to the backlight unit, wherein each gate line receives either the first gate-on voltage or the second gate-on voltage during the one frame, wherein the backlight unit is configured to be turned on while the gate-on control signal is activated and turned off while the gate-on control signal is not activated, wherein the level shifter is configured to set the gate-on voltage of the gate clock signal to the second gate-on voltage while the gate-on control signal is activated, and set the gate-on voltage of the gate clock signal to the first gate-on voltage while the gate-on control signal is not activated.

2. The display device of claim 1, wherein the gate-on control signal is activated while the portion of the gate lines disposed closest to the backlight unit is activated, and the level shifter is configured to output the first gate-on voltage as the gate-on voltage while the gate-on control signal is activated, and output the second gate-on voltage as the gate-on voltage while the gate-on control signal is not activated.

3. The display device of claim 2, wherein the gate-on control signal is output by the timing controller.

4. The display device of claim 1, wherein the level shifter comprises:

a voltage generator configured to output the first gate-on voltage and the second gate-on voltage;

a gate-on voltage selector configured to output one of the first gate-on voltage and the second gate-on voltage as the gate-on voltage in response to the gate-on control signal; and a gate clock generator configured to receive the gate-on voltage and a gate-off voltage, and output the gate clock signal in response to a gate pulse signal received from the timing controller.

5. The display device of claim 4, wherein the gate clock generator comprises:

a signal generator configured to generate a first gate pulse signal and a second gate pulse signal in response to the gate pulse signal;

a first switching circuit configured to output one of the gate-on voltage and the gate-off voltage in response to the first gate pulse signal; and a second switching circuit configured to output one of the gate-on voltage and the gate-off voltage in response to the second gate pulse signal.

6. A display device, comprising:

a display panel comprising a plurality of gate lines, a plurality of data lines, and a plurality of pixels, wherein each pixel is connected to a corresponding gate line of the gate lines and a corresponding data line of the data lines;

a gate driver configured to drive the gate lines;

a level shifter configured to apply a gate clock signal to the gate driver;

a data driver configured to drive the data lines;

a timing controller configured to generate a gate-on control signal and a plurality of control signals that control the level shifter, the gate driver, and the data driver; and a backlight unit configured to provide a light to the display panel, wherein the level shifter is configured to set a voltage level of a gate-on voltage of the gate clock signal to a voltage level of a first gate-on voltage or a voltage level of a second gate-on voltage in response to the gate-on control signal, wherein the voltage level of the second gate-on voltage is higher than the voltage level of the first gate-on voltage, wherein the data driver comprises;

a shift register configured to receive a vertical synchronization start signal from the timing controller, and output a plurality of shift signals in synchronization with a line latch signal;

a register configured to store a plurality of gate-on information signals; and a logic circuit configured to output the gate-on control signal in response to at least one of the shift signals and the gate-on information signals.

7. The display device of claim 6, wherein the gate-on information signals are set to allow the gate-on control signal to be activated while a portion of the gate lines disposed closest to the backlight unit is activated.

8. The display devices of claim 7, wherein the level shifter is configured to set the voltage level of the gate-on voltage of the gate clock signal to one of the voltage level of the first gate-on voltage and the voltage level of the second gate-on voltage in response to the vertical synchronization start signal and the gate-on control signal received from the timing controller.

9. The display device of claim 8, wherein the level shifter comprises:

a voltage generator configured to output the first gate-on voltage and the second gate-on voltage;

a gate-on voltage selector configured to output one of the first gate-on voltage and the second gate-on voltage as the gate-on voltage in response to the vertical synchronization start signal and the gate-on control signal; and a gate clock generator configured to receive the gate-on voltage and a gate-off voltage, and output the gate clock signal in response to a gate pulse signal received from the timing controller.

10. The display device of claim 9, wherein the gate-on voltage selector comprises:

a first level shifter configured to boost the vertical synchronization start signal and output a boosted vertical synchronization start signal;

a first output circuit configured to output the first gate-on voltage as the gate-on voltage in response to the boosted vertical synchronization start signal;

a second level shifter configured to boost the gate-on control signal and output a boosted gate-on control signal; and a second output circuit configured to output the second gate-on voltage as the gate-on voltage in response to the boosted gate-on control signal.

11. The display device of claim 10, wherein the first output circuit comprises:

a first diode connected between the boosted vertical synchronization start signal and a first node;

a first capacitor connected between the first node and a ground voltage;

a first transistor connected between the first node and the ground voltage; and a second transistor connected between the first gate-on voltage and an output node.

12. The display device of claim 11, wherein the second output circuit comprises:

a second diode connected between the boosted gate-on control signal and a second node;

a second capacitor connected between the second node and the ground voltage;

a third transistor connected between the second node and the ground voltage; and a fourth transistor connected between the second gate-on voltage and an output node.

13. The display device of claim 1, wherein the level shifter comprises:

a voltage generator configured to output the first gate-on voltage and the second gate-on voltage;

a gate-on voltage selector configured to output one of the first gate-on voltage and the second gate-on voltage as the gate-on voltage in response to a backlight control signal received from the timing controller; and a gate clock generator configured to receive the gate-on voltage and a gate-off voltage, and output the gate clock signal in response to a gate pulse signal received from the timing controller.

14. The display device of claim 13, wherein the gate-on voltage selector comprises:

a first level shifter configured to boost the backlight control signal and output the boosted backlight control signal;

a first output circuit configured to output the second gate-on voltage as the gate-on voltage in response to the boosted backlight control signal;

an inverter configured to receive the backlight control signal, invert the backlight control signal, and output the inverted backlight control signal;

a second level shifter configured to boost the inverted backlight control signal and output the boosted inverted backlight control signal; and a second output circuit configured to output the first gate-on voltage as the gate-on voltage in response to the boosted inverted backlight control signal.

15. The display device of claim 14, wherein the first output circuit comprises:

a first capacitor connected between the boosted backlight control signal and a ground voltage; and a first transistor connected between the second gate-on voltage and an output node.

16. The display device of claim 15, wherein the second output circuit comprises:

a second capacitor connected between the boosted inverted backlight control signal and the ground voltage; and a second transistor connected between the first gate-on voltage and the output node.

* * * * *